US005725150A

United States Patent [19]

Allen et al.

[11] Patent Number: 5,725,150

[45] Date of Patent: Mar. 10, 1998

[54] METHOD AND SYSTEM FOR AN IMPROVED VOLTAGE BLOCK

[75] Inventors: Harold T. Allen, Indianapolis, Ind.; Edward T. Feldman, Buffalo Grove, Ill.; Varce E. Howe, Zionsville, Ind.; Ghaffar Kazkaz, Mount Prospect, Ill.; Jerry L. McPherson, Jr., Greenfield; James Scharfenberger, Indianapolis, both of Ind.

[73] Assignee: Illinois Tool Works Inc., Glenview, Ill.

[21] Appl. No.: 647,857

[22] Filed: May 15, 1996

Related U.S. Application Data

[63] Continuation-in-part of Ser. No. 429,019, May 3, 1995, Pat. No. 5,632,816.

[51] Int. Cl.[6] ..... B05B 5/025

[52] U.S. Cl. ..... 239/3; 239/708; 239/305; 118/629; 427/483

[58] Field of Search ..... 239/690, 708, 239/3, 305; 118/629, 621, 302; 427/483, 484, 421

[56] References Cited

U.S. PATENT DOCUMENTS

| | | | |
|---|---|---|---|
| 4,313,475 | 2/1982 | Wiggins | 118/506 X |
| 4,792,092 | 12/1988 | Elberson et al. | 427/483 X |
| 4,962,724 | 10/1990 | Prus et al. | 239/690 X |
| 5,078,168 | 1/1992 | Konieczynski | 239/691 X |
| 5,094,389 | 3/1992 | Giroux et al. | 118/629 X |
| 5,102,045 | 4/1992 | Diana | 118/629 X |
| 5,326,031 | 7/1994 | Konieczynski | 239/708 X |
| 5,364,035 | 11/1994 | Ma et al. | 239/690 |

*Primary Examiner*—Lesley D. Morris

*Attorney, Agent, or Firm*—John P. O'Brien; Thomas W. Buckman; Donald J. Bech

[57] ABSTRACT

A method and system for supplying electrically conductive coating materials to an electrostatic dispenser with a parallel arrangement of subsystems selectably coupled to the dispenser by a four-port system voltage blocking valve, which electrically isolates the subsystems. The subsystems each include first and second piston cylinders that alternatingly receive a selected coating material from a corresponding manifold and supply the coating material to the dispenser by a subsystem voltage blocking valve, which isolates the dispenser from the manifold, when coupled to the dispenser. The first and second piston cylinders of each subsystem also alternatingly receive a solvent from the corresponding manifold and direct the solvent to a waste receptacle by a corresponding subsystem voltage blocking valve when the subsystem is not coupled to the dispenser. The solvent removes previously supplied coating material from the non-selected subsystem and readies the non-selected subsystem for supplying a next selected coating material to the dispenser.

8 Claims, 1 Drawing Sheet

METHOD AND SYSTEM FOR AN IMPROVED VOLTAGE BLOCK

CROSS-REFERENCE TO RELATED APPLICATIONS

The present application is a continuation in part of U.S. application Ser. No. 08/429,019 entitled "Voltage Block" filed on May 3, 1995, now U.S. Pat. No. 5,632,816, assigned to the assignee of the present invention and incorporated by reference herein.

BACKGROUND OF THE INVENTION

The invention relates generally to a method and system for supplying fluids to a dispenser, and more particularly to a method and system for supplying electrically conductive coating materials to an electrostatic dispenser with a parallel arrangement of subsystems selectably coupled to the dispenser, wherein the dispenser atomizes and dispenses electrostatically charged particles of the coating material toward a target article at a reference electrical potential.

Fluid supply systems that supply fluid from one or more different fluid sources and through a common supply portion of the system to one or more dispensers have many industrial applications, including food processing and manufacturing applications, wherein it is necessary to substantially eliminate any residue from the common supply portion of the system before changing fluid supply sources to prevent cross-contamination of the different fluids supplied by the system. Many applications moreover require that the fluid supplied by the system be frequently changed over a time period on the order of tens of seconds or less without compromising productivity. For example, production lines in the automobile industry change frequently selected coating materials, like different colored paints, dispensed from fluid supply systems. To keep pace with increasingly fast production lines, the automobile industry seeks to reduce the coating material change time to an interval that is approaching the order of several seconds. Other types of fluid supply systems and applications also require increasingly rapid fluid source changes without contamination of the different fluids supplied by the fluid supply system. One exemplary type of fluid supply system is a coating material supply system that atomizes and dispenses electrostatically charged particles of the coating material from a reservoir toward a target article at a different electrical potential to which the coating material adheres advantageously as is known in the art. These systems are increasingly configured to supply water-based coating materials that are less hazardous to use in the work place and less degrading to the environment. Water-based coating materials however are relatively conductive and require a voltage block between the water-based coating material reservoir, which is at electrical ground potential, and the dispenser, which is at an electrical potential relative to ground potential. These water-based systems are used in many industries, including the automobile industry, that require increasingly rapid fluid source changes without contamination of the different fluids supplied by the fluid supply system. The supplying of water-based coating materials with an electrostatic system however further complicates the problem of reducing coating material change time due to the requirement of voltage blocks.

The related copending U.S. application Ser. No. 08/429,019 entitled "Voltage Block" filed on May 3, 1995, now U.S. Pat. No. 5,632,816, discloses an electrostatic water-based coating material supply system with parallel A and B subsystems separated from a dispenser by an arrangement of voltage blocks, which system reduces coating material change time without cross-contamination among different coating materials supplied by the system. In the embodiment of FIG. 4 of the copending application, each subsystem interconnects a coating material dispenser with a corresponding manifold coupled selectively to one of several coating material supplies, which are at ground electrical potential. A system three-port voltage blocking valve couples selectively either the A or B subsystem to the dispenser and isolates the non-selected subsystem from the dispenser, which is at an electrical potential relative to ground potential. The selected subsystem supplies a selected coating material to the dispenser while coating material is removed from the non-selected subsystem by flushing solvent and air through the non-selected subsystem to ready the non-selected subsystem for supplying the next selected coating material. Each subsystem supplies the selected coating material to the dispenser by alternatingly coupling the selected coating material supply to one of two electrically isolated cylinders each having a reciprocating piston. Each cylinder alternatingly supplies the selected coating material to the dispenser while the other cylinder is being supplied with coating material from the selected coating material supply. Each cylinder is alternatingly coupled to the selected coating material supply by a corresponding three-port voltage blocking valve having a first port coupled to the cylinder, a second port coupled to the manifold, and a third port coupled to the system three-port voltage blocking valve. A first three-port voltage blocking valve in a supply configuration couples the first cylinder to the selected coating material supply to supply coating material to the first cylinder, and decouples the first cylinder from the system three-port voltage blocking valve. The first three-port voltage blocking valve also electrically isolates the first cylinder and coating material supply, both at electrical ground potential, from the system three-port voltage blocking valve, which may be at an electrical potential relative to ground potential. As the first cylinder is being supplied with coating material, the first piston moves the second piston via a common shaft to dispense coating material from the second cylinder. A second three-port voltage blocking valve in a dispense configuration couples the second cylinder to the system voltage blocking valve to permit coating material to be supplied from the second cylinder to the dispenser, and decouples the second cylinder from the selected coating material supply. The second voltage blocking valve also electrically isolates the second cylinder coupled to the dispenser, which are both at an electrical potential relative to ground potential, from the coating material supply, which is at electrical ground potential. The system three-port voltage blocking valve permits coating material to be supplied to the dispenser from the selected subsystem while decoupling and electrically isolating the non-selected subsystem from the dispenser. The decoupled subsystem may be prepared for dispensing another coating material by cycling the pistons in the cylinders with solvent and air to remove any coating material in the manifold, valves, conduits, and cylinders of the subsystem. The contaminated solvent is collected at one or more dump sites of each subsystem, and the flushed subsystem is air dried before dispensing the next selected coating material. Each subsystem requires its own solvent flushing and collection system, which is generally at electrical ground potential. In addition, between selection of subsystems, coating material is removed and flushed from the dispenser and conduits coupling the dispenser to the subsystems by a separate flushing and collection system maintained at the same electrical potential as the dispenser.

The parallel coating material supply system of the related application discussed above reduces the coating material change time to the time required to remove and flush coating material from the dispenser and related conduits, which time frame is generally on the order of tens of seconds. The voltage blocking valves required to operate the parallel sub-systems however are relatively expensive components. The system requires at least one system voltage blocking valve to interconnect the subsystems to the dispenser, and each subsystem requires at least two additional voltage blocking valves to alternatingly supply fluid to and from the cylinders of each double piston cylinder thereby making the voltage blocking valves a substantial proportion of the overall system cost.

In view of the discussion above, there exists a demonstrated need for an advancement in the art of supplying fluids to a dispenser.

It is therefore an object of the invention to provide a novel method and system for supplying fluids to a dispenser that overcomes problems with the prior art.

It is also an object of the invention to provide a novel method and system for supplying a coating material to an electrostatic coating material dispenser.

It is another object of the invention to provide a novel method and system for supplying a coating material to an electrostatic coating material dispenser that reduces the time required to change the coating materials supplied to the dispenser.

It is another object of the invention to provide a novel method and system for supplying a coating material to an electrostatic dispenser that reduces the required number of system components, including the number of voltage blocking valves and solvent flushing subsystems.

It is a further object of the invention to provide a novel method and system for supplying a coating material to an electrostatic dispenser that reduces the required amount of solvent to remove any coating material from the system to prevent cross contamination of different coating materials supplied to the dispenser.

It is a further object of the invention to provide a novel method and system for supplying an electrically conductive coating material to an electrostatic coating material dispenser in a parallel arrangement of subsystems that decrease the required number of voltage blocking valves.

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators.

BRIEF DESCRIPTION OF THE DRAWINGS

The FIGURE is a schematic view of an improved voltage blocking fluid supply system with selectable subsystems according to an exemplary embodiment of the invention.

DETAILED DESCRIPTION OF THE INVENTION

Figure 1:
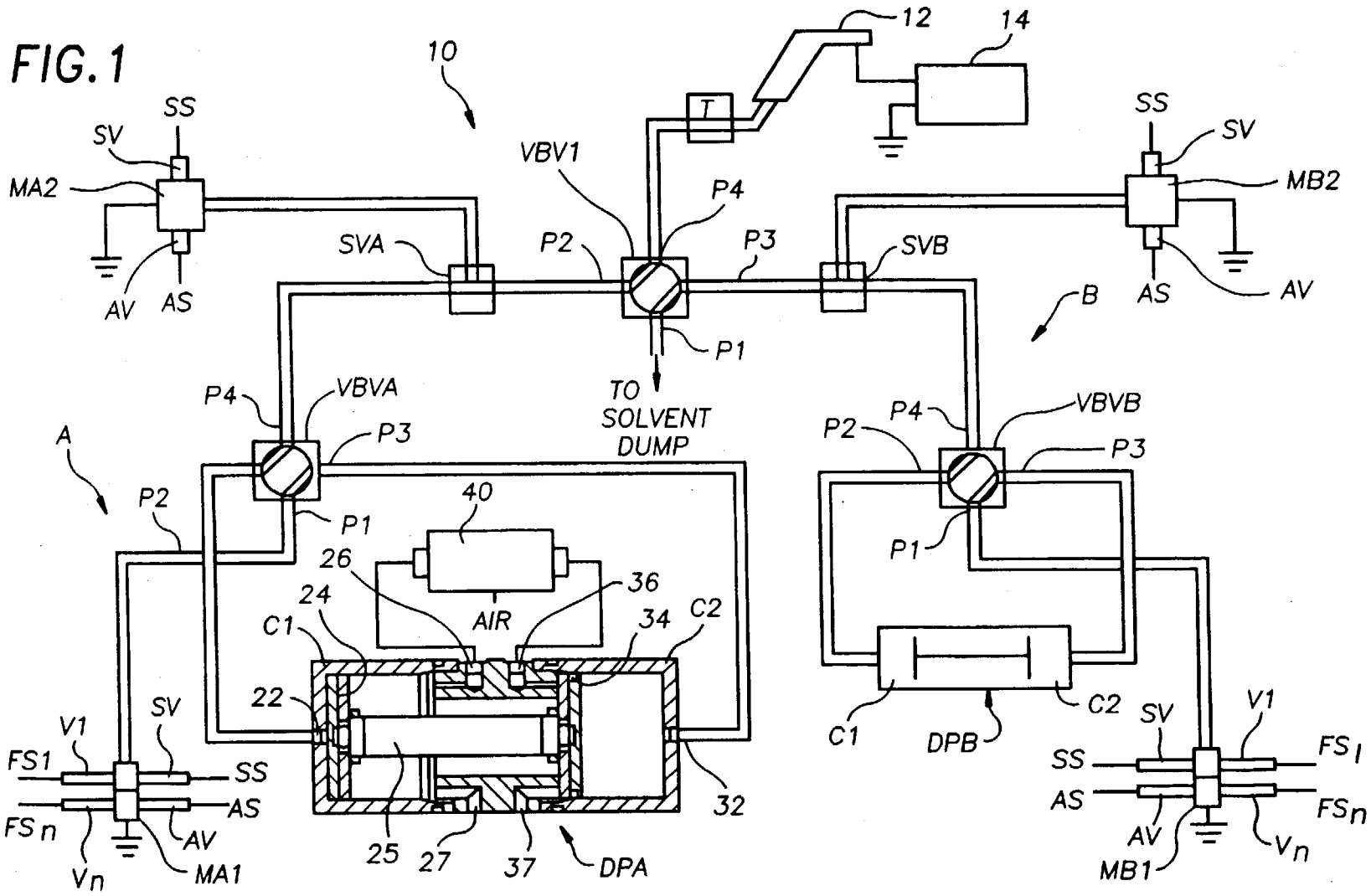

The FIGURE is a schematic view of a parallel fluid supply system 10, which in the exemplary embodiment is an electrostatic water-based coating material supply system, with a parallel arrangement of subsystems A and B coupled to the dispenser by a system voltage blocking valve VBV1. Each subsystem includes a corresponding manifold MA1, MB1 at a first electrical potential, which is generally electrical ground, coupled to one or more selectable fluid supplies FS1 through FSn not shown in the drawing, by corresponding valves V1 through Vn. A solvent supply SS and an air supply AS is also coupled to each manifold MA1, MB1 by a corresponding solvent supply valve SV and a corresponding air supply valve AV. Each manifold MA1, MB1 is coupled to a port P1 of a corresponding four-port voltage blocking valve VBVA, VBVB having ports P2 and P3 coupled to cylinders C1 and C2 of a corresponding double piston cylinder DPA, DPB. Port P4 of each voltage blocking valve VBVA, VBVB is coupled to ports P2 and P3, respectively, of the system voltage blocking valve VBV1, which in the exemplary embodiment is also a four-port voltage blocking valve. A fourth port P4 of the system valve VBV1 is coupled to a fluid dispenser 12, which is actuatable by a trigger T and maintainable at a second electrical potential by an electrical power supply 14, which in the exemplary embodiment is a high voltage power supply. The fluid dispenser 12 and power supply 14 combination is capable of atomizing and electrostatically charging a selected fluid supplied to the dispenser 12, and directing the atomized and charged fluid to a target, not shown, at a reference electrical potential, which is usually electrical ground. A valve SVA couples port P2 of the system voltage blocking valve VBV1 to a manifold MA2, and a valve SVB couples port P3 of the system voltage blocking valve VBV1 to a manifold MB2. Each manifold MA2, MB2 has a corresponding solvent supply valve SV coupled to a solvent supply SS and a corresponding air supply valve AV coupled to an air supply AS for flushing fluid from the system valve VBV1 and the dispenser 12 as discussed below. In an alternative embodiment, a common manifold is coupled to valves SVA and SVB to supply air and solvent for flushing the system valve VBV1 and the dispenser 12. The manifolds, valves, dispenser, double piston cylinders and other system components are interconnected by a fluid supply line or conduit suitable for supplying fluids and solvent.

The double piston cylinder DPA illustrates the basic components of the double piston cylinders in the respective subsystems. The double piston cylinder DPA comprises two self-contained first and second cylinders C1 and C2 with a respective port 22, 32 in a corresponding head portion of the cylinder coupled to ports P2 and P3 of the valve VBVA as discussed above. In an electrostatic system that dispenses an electrically conductive fluid, like a water-based coating material, the cylinder C1 is also electrically isolated from the cylinder C2, and from other components of the system as further discussed below. Each cylinder includes a corresponding piston 24, 34 coupled to a common connecting rod or shaft 25 that permits reciprocating action of the pistons, which are also electrically isolated, in the respective cylinders. The pistons are reciprocated by the alternating supply of fluid from the ports P2 and P3 of the valve VBVA. Each cylinder includes an inlet air port 26, 36 and an outlet air port 27, 37 through which air is supplied by a corresponding pneumatic sensor 40 that senses the position of the pistons in the corresponding cylinders. As shown in the first cylinder C1, the air supplied by the sensor 40 flows into the inlet port 26, through an empty portion of the cylinder, and exhausts through the outlet port 27 of the cylinder C1 when the piston is away from a base portion of the cylinder. As the cylinder is filled with fluid, the piston moves away from the head portion of the cylinder until the piston reaches the travel limit of its stroke and is positioned at the base of the cylinder. As the piston moves toward the base of the cylinder, as a result of fluid supplied to the cylinder C2 as shown by piston 34, the piston obstructs the flow of air through one or more of the inlet and output ports resulting in a change in air pressure that is detectable by the sensor 40. The change in pressure causes the sensor to directly actuate the voltage blocking valve VBVA by pneumatically rotating the valve, 90 degrees in the embodiment of FIG. 1, to couple port P1 with port P2 and to couple port P3 with port P4. The valve VBVA then directs the supply of fluid to the empty cylinder, cylinder C1 in the configuration of FIG. 1, and directs the supply of fluid from the filled cylinder, cylinder C2 in the configuration of FIG. 1, to the dispenser as further discussed below. Alternatively, the sensor may be a transducer that generates an electrical control signal when the pressure is increased to a threshold pressure indicating that the piston has reached the limit of its stroke in the fluid filled cylinder, which is usable alone or with a control means to rotate the valve VBVA. The control means may be a programmable logic controller that controls the valve VBVA, VBVB and VBV1 as well as the fluid supply valves, solvent valves, air supply valves, dispenser, and voltage supply.

In electrostatic systems that dispense a conducting fluid like a water-based coating material, the system valve VBV1 is a four-port voltage blocking valve that electrically isolates the subsystem A from subsystem B of the type disclosed and described in the related copending U.S. application Ser. No. 08/429,019 entitled "Voltage Block" filed on May 3, 1995. In FIG. 1 of the present application, valve VBV1 electrically isolates coupled ports P3 and P4 from coupled ports P1 and P2 to electrically isolate subsystem A from subsystem B, which is coupled to the dispenser. Similarly, when subsystem A is coupled to the dispenser, valve VBV1 electrically isolates coupled ports P1 and P3 from coupled ports P2 and P4 to electrically isolate subsystem A from subsystem B. The subsystem not supplying fluid to the dispenser is at the first potential of its manifold MA1 or MB1, and the subsystem supplying fluid to the dispenser is in part at the second potential of the dispenser as discussed below. The valves VBVA and VBVB are also four-port voltage blocking valves, and electrically isolate the system valve VBV1, which is in part at the second potential of the dispenser, from the corresponding manifold MA1, MB1, which are at the first potential. In FIG. 1 of the present application, valve VBVB electrically isolates coupled ports P2 and P4 from coupled ports P1 and P3. The coupled ports P2 and P4 and the cylinder C1, supplying fluid to the dispenser, are at the second potential of the dispenser, and the coupled ports P1 and P3 and the cylinder C2, receiving fluid from the manifold MB1, are at the first potential of the manifold MB1. Similarly, when cylinder C2 supplies fluid to the dispenser and C1 receives fluid from the manifold, the coupled ports P3 and P4 are at the second potential of the dispenser, and the coupled ports P1 and P2 are at the first potential of the manifold MB1. The valve VBVA of subsystem A operates similarly when subsystem A is coupled to the dispenser by the system valve VBV1.

In operation, one of the parallel subsystems supplies a selected electrically conductive water-based coating material to the dispenser 12 while the other subsystem is made ready for supplying the next selected coating material to the dispenser. In the configuration of FIG. 1, the system valve VBV1 is configured to couple subsystem B to the dispenser 12 wherein a selected coating material from one of the fluid supplies FS1 through FSn is alternatingly supplied to the cylinders C1 and C2 of the double piston cylinder DPB and to the dispenser 12 through valve VBVB as discussed above. The subsystem not coupled to the dispenser, subsystem A in FIG. 1, is made ready for supplying the next selected coating material to the dispenser by supplying solvent, or a mixture of solvent and air, from the manifold MA1 or MB1 to remove the previously supplied coating material from the corresponding subsystem. The solvent and air are cycled through the cylinders C1 and C2 of the corresponding double piston cylinder DPA or DPB, then out through port P1 of the system valve VBV1 and into an appropriate solvent dump not shown in the drawing. In the exemplary embodiment, the valve VBVA alternatingly directs the flow of solvent from the manifold MA1 to the cylinders C1 and C2 of the double piston cylinder DPA until the double piston cylinder DPA, valve VBVA, ports P1 and P2 of valve VBV1, and interconnecting conduits are sufficiently clean to prevent contamination of the next selected coating material from subsystem A. After the coating material residue is removed from the subsystem, air may be supplied through the subsystem to purge and evaporate solvent from the subsystem. During the solvent flushing and air purging process of subsystem A, the fluid supply valves V1 through Vn are closed, solvent supply valve SV is opened, and valve SVA is configured to isolate manifold MA2 from valve VBVA and to permit solvent flow from the valve VBVA to the valve VBV1.

Upon completion of the supply of coating material from subsystem B to the dispenser 12, the selected fluid supply valves V1 through Vn of subsystem B are closed. Before configuring the system valve VBV1 to couple subsystem A to the dispenser however coating material is removed from the dispenser 12 by configuring valve SVB to connect the port P3 of valve VBV1 to manifold MB2 and to isolate port P3 from valve VBVB. Solvent, or a solvent and air mixture, is then supplied from the manifold MB2 through the ports P3 and P4 of valve VBV1, through the dispenser 12, and into an appropriate solvent receptacle not shown in the drawing. It will take on the order of ten seconds to sufficiently remove coating material from the system valve VBV1, the dispenser 12, and interconnecting conduits to prevent contamination of the next selected coating material. The valve VBV1 is then actuated to couple subsystem A to the dispenser, by coupling port P2 with port P4 of valve VBV1, for supplying the next selected coating material from subsystem A to the dispenser 12. The system voltage blocking valve VBV1 electrically isolates the subsystems A and B from each other, and the voltage blocking valves VBVA and VBVB of the subsystem supplying the selected coating material to the dispenser electrically isolates the cylinders C1 and C2 of the corresponding double piston cylinder as discussed above.

While the foregoing written description of the invention enables any one skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by the embodiments within the scope of the appended claims.

What is claimed is:

1. A method for supplying a selected fluid to a dispenser, which is usable to supply an electrically conductive coating material at a first electrical potential to an electrostatic dispenser at a second electrical potential, the method comprising steps of:

coupling one of at least two subsystems to the dispenser with a system voltage blocking valve to supply a selected coating material from the subsystem coupled to the dispenser;

electrically isolating the subsystem coupled to the dispenser from the subsystem not coupled to the voltage blocking valve;

directing the selected coating material from a first supply manifold and into a first piston cylinder of the subsystem coupled to the dispenser with a first four-port voltage blocking valve of the subsystem coupled to the dispenser, and directing the selected coating material from a second piston cylinder of the subsystem coupled to the dispenser to the system valve with the first four-port voltage blocking valve of the subsystem coupled to the dispenser; and directing solvent from a second supply manifold and into a first piston cylinder of the subsystem not coupled to the dispenser with a second four-port voltage blocking valve of the subsystem not coupled to the dispenser, and directing solvent from a second piston cylinder of the subsystem not coupled to the dispenser to the system valve with the second four-port voltage blocking valve of the subsystem not coupled to the dispenser to remove fluid from the subsystem not coupled to the dispenser and a portion of the system voltage blocking valve.

2. The method according to claim 1 further comprising steps of removing fluid from the dispenser and from a portion of the system voltage blocking valve by directing solvent through a portion of the subsystem coupled to the dispenser, through the system voltage blocking valve, and through the dispenser before coupling another subsystem to the dispenser.

3. A system for supplying fluid to a dispenser, the system comprising:

a system voltage blocking valve for selectively coupling one of at least a first subsystem and a second subsystem to the dispenser, the voltage blocking valve electrically isolating the first subsystem from the second subsystem;

the first subsystem having a first voltage blocking valve alternatingly interconnecting a first fluid supply manifold with a first cylinder having a first movable piston and a second cylinder having a second movable piston, and the first voltage blocking valve alternatingly interconnecting the first cylinder and the second cylinder with the dispenser to direct the selected first fluid to the dispenser when the first subsystem is coupled to the dispenser;

the second subsystem having a second voltage blocking valve alternatingly interconnecting a second fluid supply manifold with a third cylinder having a third movable piston and a fourth cylinder having a fourth movable piston, the second voltage blocking valve alternatingly interconnecting the third cylinder and the fourth cylinder with the dispenser to direct the selected second fluid to the dispenser when the second subsystem is coupled to the dispenser;

wherein when one of the first subsystem and the second subsystem is coupled to the dispenser by the system voltage blocking valve to supply a selected fluid to the dispenser, then the other of the first subsystem and the second subsystem is made ready for dispensing a next selected fluid to the dispenser.

4. The system according to claim 3 wherein the voltage blocking valve of each subsystem is a single four-port voltage blocking valve.

5. The system according to claim 3 wherein the first manifold is capable of selectively supplying a first electrically conductive coating material, solvent, and air at a first electrical potential, the second manifold is capable of selectively supplying a second electrically conductive coating material, solvent and air at the first electrical potential, the dispenser is an electrostatic dispenser at a second electrical potential for dispensing a selected coating material, the first subsystem including a first valve for supplying solvent to the system voltage blocking valve and the dispenser, and the second subsystem including a second valve for supplying solvent to the system voltage blocking valve and the dispenser.

6. The system according to claim 5 wherein the system voltage blocking valve, the first voltage blocking valve, and the second voltage blocking valve each have at least four-ports and two separate passage ways, each passage way selectably configurable to couple two ports of the at least four ports of the corresponding valve.

7. The system according to claim 5 wherein the first cylinder and first piston are electrically isolated from the second cylinder and the second piston.

8. The system according to claim 7 wherein the first piston is interconnected to the second piston by a common shaft, and the first and second cylinders form a double piston cylinder.

* * * * *